US012486624B2

(12) United States Patent
Johnson et al.

(10) Patent No.: US 12,486,624 B2
(45) Date of Patent: Dec. 2, 2025

(54) CONCRETE FINISHING MACHINE WITH ADJUSTABLE FLOAT

(71) Applicant: Somero Enterprises, Inc., Ft. Myers, FL (US)

(72) Inventors: Grant A. Johnson, Hancock, MI (US); Trevor Eenigenburg, Houghton, MI (US); Philip D. Halonen, Calumet, MI (US); Mark A. Pietila, Atlantic Mine, MI (US)

(73) Assignee: Somero Enterprises, Inc., Ft. Myers, FL (US)

( * ) Notice: Subject to any disclaimer, the term of this patent is extended or adjusted under 35 U.S.C. 154(b) by 916 days.

(21) Appl. No.: 17/657,652

(22) Filed: Apr. 1, 2022

(65) Prior Publication Data

US 2022/0316154 A1 Oct. 6, 2022

Related U.S. Application Data

(60) Provisional application No. 63/264,254, filed on Nov. 18, 2021, provisional application No. 63/200,945, filed on Apr. 5, 2021.

(51) Int. Cl.
*E01C 19/42* (2006.01)
*E01C 19/26* (2006.01)

(52) U.S. Cl.
CPC ..... *E01C 19/42* (2013.01); *E01C 19/26* (2013.01); *E01C 19/266* (2013.01)

(58) Field of Classification Search
CPC ..... E01C 19/26; E01C 19/266; E01C 19/42
USPC ..... 404/83, 118, 120
See application file for complete search history.

(56) References Cited

U.S. PATENT DOCUMENTS 2,962,946 A * 12/1960 Neff ..... E01C 19/15 404/101
3,605,579 A * 9/1971 Hetzel ..... E01C 19/43 404/93
4,655,633 A 4/1987 Somero et al.
(Continued)

FOREIGN PATENT DOCUMENTS

CN 2575142 9/2003
WO 2006133490 A1 12/2006

OTHER PUBLICATIONS

International Search Report and Written Opinion dated Jun. 16, 2022 from corresponding PCT Application No. PCT/US2022/071493.

*Primary Examiner* — Raymond W Addie
(74) *Attorney, Agent, or Firm* — HONIGMAN LLP

(57) ABSTRACT

A concrete finishing machine includes a base portion and an extendable and retractable boom mounted at the base portion, and a finishing head mounted at a distal end of the boom. The finishing head includes (i) a float pivotally attached at a frame of the finishing head via a plurality of linkages, (ii) a float actuator that, when actuated, imparts pivotal movement of the linkages to adjust the float relative to the frame, and (iii) a surface finishing element. The concrete finishing machine is operable to selectively position the float or the surface finishing element at the concrete surface during extension or retraction of the boom. Responsive to a sensing device, the finishing head is maintained at a desired level or position above the concrete surface with the float or the surface finishing element at the concrete surface during extension or retraction of the boom.

27 Claims, 15 Drawing Sheets

(56) References Cited

U.S. PATENT DOCUMENTS

| | | | | |
|---|---|---|---|---|
| 4,752,154 | A * | 6/1988 | Valentine | E01C 19/44 404/101 |
| 4,917,533 | A * | 4/1990 | Wilson | E01C 11/005 404/96 |
| 4,930,935 | A | 6/1990 | Quenzi et al. | |
| 4,966,490 | A * | 10/1990 | Hodson | E01C 19/488 118/118 |
| 6,227,761 | B1 | 5/2001 | Kieranen et al. | |
| 6,976,805 | B2 | 12/2005 | Quenzi et al. | |
| 7,044,681 | B2 | 5/2006 | Quenzi et al. | |
| 7,121,762 | B2 | 10/2006 | Quenzi et al. | |
| 7,144,191 | B2 | 12/2006 | Kieranen et al. | |
| 7,175,363 | B2 | 2/2007 | Quenzi et al. | |
| 7,396,186 | B2 | 7/2008 | Quenzi et al. | |
| 7,850,396 | B2 | 12/2010 | Pietila et al. | |
| 9,835,610 | B2 | 12/2017 | Kangas | |
| 10,156,048 | B1 | 12/2018 | Springborg | |
| 10,190,268 | B2 | 1/2019 | Pietila et al. | |
| 10,895,045 | B2 | 1/2021 | Kangas | |
| 2003/0031510 | A1* | 2/2003 | Suriano | E01C 19/44 404/118 |
| 2006/0018715 | A1* | 1/2006 | Halonen | E01C 19/15 404/118 |
| 2007/0116520 | A1 | 5/2007 | Quenzi et al. | |
| 2010/0158608 | A1* | 6/2010 | Wilson, Sr. | E01C 19/21 404/113 |
| 2010/0196096 | A1 | 8/2010 | Halonen et al. | |
| 2018/0327982 | A1* | 11/2018 | Leukuma | E04F 21/244 |
| 2019/0186083 | A1 | 6/2019 | Kangas | |

* cited by examiner

CONCRETE FINISHING MACHINE WITH ADJUSTABLE FLOAT

CROSS REFERENCE TO RELATED APPLICATIONS

The present application claims the filing benefits of U.S. provisional application Ser. No. 63/264,254, filed Nov. 18, 2021, and U.S. provisional application Ser. No. 63/200,945, filed Apr. 5, 2021, which are hereby incorporated herein by reference in their entireties.

FIELD OF THE INVENTION

The present invention relates generally to concrete finishing machines for leveling and smoothing and finishing of concrete that has been placed over a surface.

BACKGROUND OF THE INVENTION

Screeding devices or machines are used to level and smooth uncured concrete to a desired grade. Known screeding machines typically include a screed head, which includes a vibrating member and a grade setting device, such as a plow or an auger device. The screed head is vertically adjustable, such as in response to a laser leveling system, to establish the desired grade at the vibrating member. Examples of such screeding machines are described in U.S. Pat. Nos. 4,655,633; 4,930,935; 6,227,761; 7,044,681; 7,175,363 and 7,396,186, which are hereby incorporated herein by reference in their entireties. After the concrete is screeded, a bull float may be used to finish the concrete surface. Such bull floats are typically attached at the end of a pole and manually moved over the concrete surface.

SUMMARY OF THE INVENTION

A concrete finishing machine for finishing a concrete surface includes a base portion and an extendable and retractable boom mounted at the base portion. A finishing head is mounted at an end of the boom distal from the base portion. The finishing head comprises a float (e.g., a bull float or a channel float or a trowel or the like) pivotally attached at a frame of the finishing head via a plurality of linkages. The finishing head comprises a float actuator that, when actuated, imparts pivotal movement of the linkages to adjust the float relative to the frame. The finishing head also comprises a surface finishing element. The concrete finishing machine is operable to selectively position the float or the surface finishing element at the concrete surface during extension or retraction of the boom. The concrete finishing machine comprises a sensing device. Responsive to the sensing device, the finishing head is maintained at a desired level or position or height or distance above the concrete surface with the float or the surface finishing element at the concrete surface during extension or retraction of the boom.

These and other objects, advantages, purposes and features of the present invention will become apparent upon review of the following specification in conjunction with the drawings.

DESCRIPTION OF THE PREFERRED EMBODIMENTS

Figure 1:
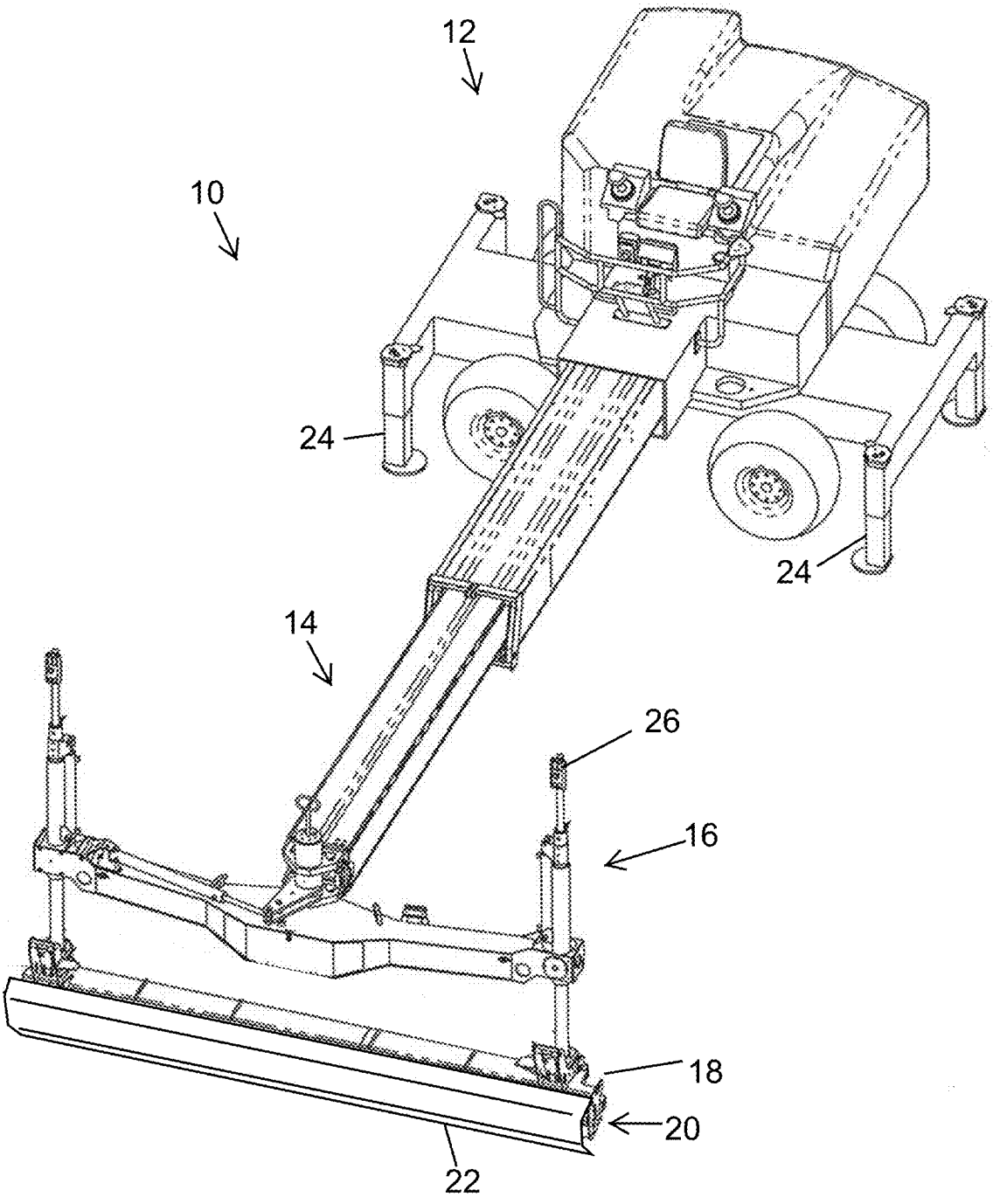
FIG. 1 is a perspective view of a concrete finishing machine.

Referring now to the drawings and the illustrative embodiments depicted therein, a concrete finishing machine 10 includes a base unit 12 (which may comprise a wheeled unit as shown in FIG. 1 or may comprise any other form of base unit or structure) with a boom 14 extending therefrom and supporting a finishing head or assembly 16 at an outer end thereof (FIG. 1). The base unit 12 is movable or drivable to a targeted area at a support surface with uncured concrete placed thereat, and the base unit may include an upper portion that rotates about a base portion to swing the boom and finishing head to a targeted location. The boom 14 is extendable and retractable to move the finishing head 16 over the placed concrete, while the finishing head 16 is operable to smooth or finish the concrete. In the illustrated embodiment, the finishing head includes a float 18 (e.g., a bull float or a channel float or a trowel or the like), a broom or brush element 20 and a spraying device 22. The finishing machine includes a plurality of stabilizers 24, which may be extendable and retractable, to support and stabilize the machine on the support surface during the screeding operation.

The controller of the screeding machine individually controls the elevation cylinders of the screed head responsive to signals generated by the laser receivers 26, which sense a laser reference plane generated at the work site. Although shown in FIG. 1 as being responsive to a laser leveling system that includes leveling cylinders and laser receivers at opposite ends of the head, the finishing head may be responsive to other sensors, such as ultrasonic sensors or laser sensors or the like (see FIGS. 6-9) that sense and maintain a distance or height of the head at and over the concrete surface, such as by utilizing aspects of the machines described in U.S. Pat. No. 6,227,761, which is hereby incorporated herein by reference in its entirety.

Finishing machine 10 and the finishing head or assembly 16 may be similar in construction and/or operation as the screeding and/or finishing and/or spraying machines and heads described in U.S. Pat. Nos. 4,655,633; 4,930,935;

7,044,681; 7,175,363; 7,396,186; 9,835,610; 10,156,048 and/or 10,895,045, and/or U.S. Publication Nos. US-2007-0116520 and/or US-2010-0196096, which are all hereby incorporated herein by reference in their entireties, such that a detailed discussion of the overall construction and operation of the machines and heads need not be repeated herein. However, aspects of the present invention are suitable for use on other types of machines. For example, the finishing head of the surface finishing machine may be suitable for use on a smaller machine, such as a machine of the types described in U.S. Pat. Nos. 6,976,805; 7,121,762 and/or 7,850,396, which are hereby incorporated herein by reference in their entireties. Optionally, the finishing head may be used on other types of machines, such as a machine with the head mounted at an articulatable boom, such as of the types described in U.S. Pat. No. 10,190,268, which is hereby incorporated herein by reference in its entirety.

The machine relies on data to accurately control pitch and roll of the finishing head. Pitch is the fore/aft tilt of the head about its longitudinal axis. An SLS (Self Level System) actuator 28 controls the head angle as the boom is extended and retracted.

Figure 2:
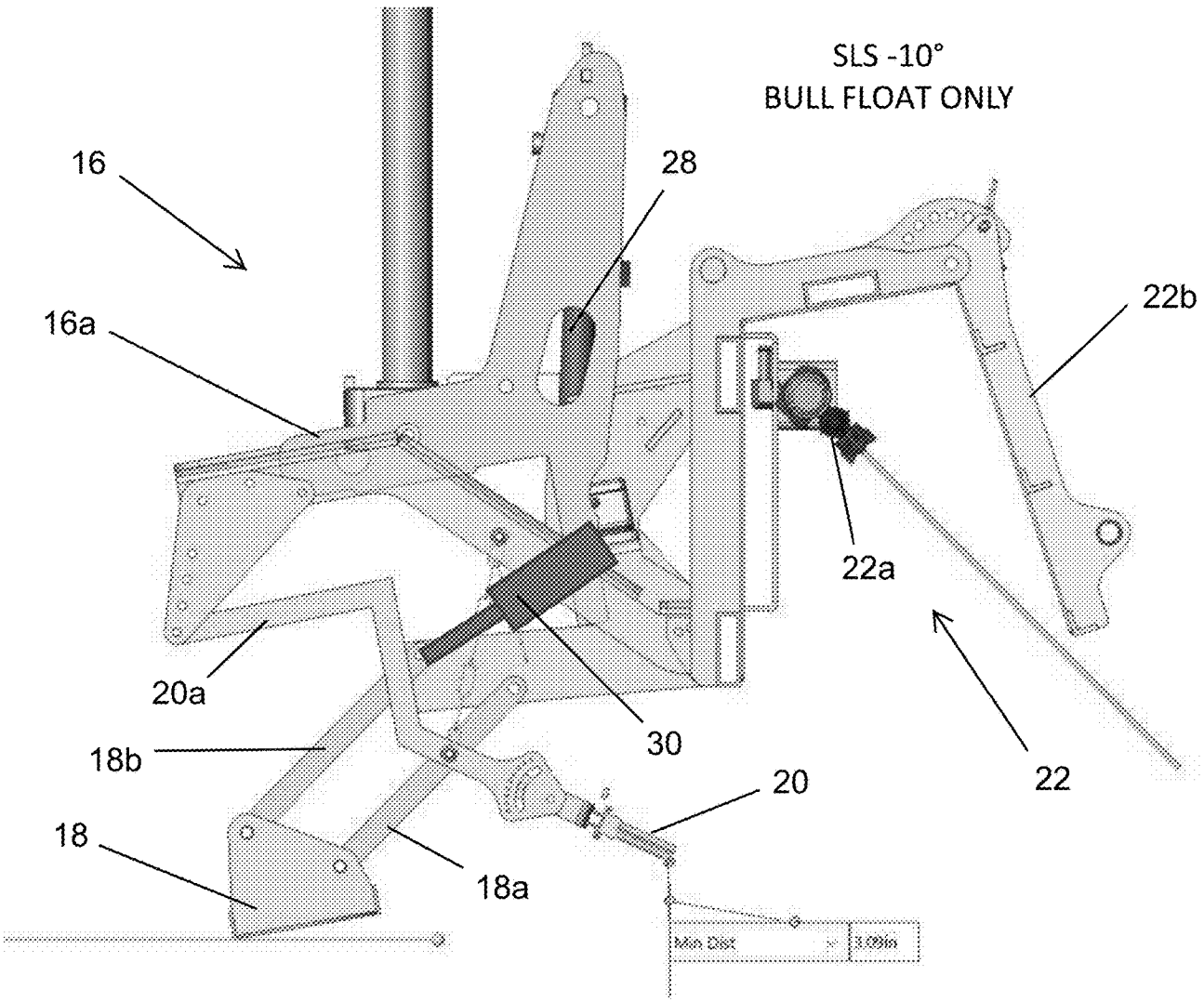
FIG. 2 is a side elevation of a finishing head with a bull float and a broom/texturing element.
Figure 3:
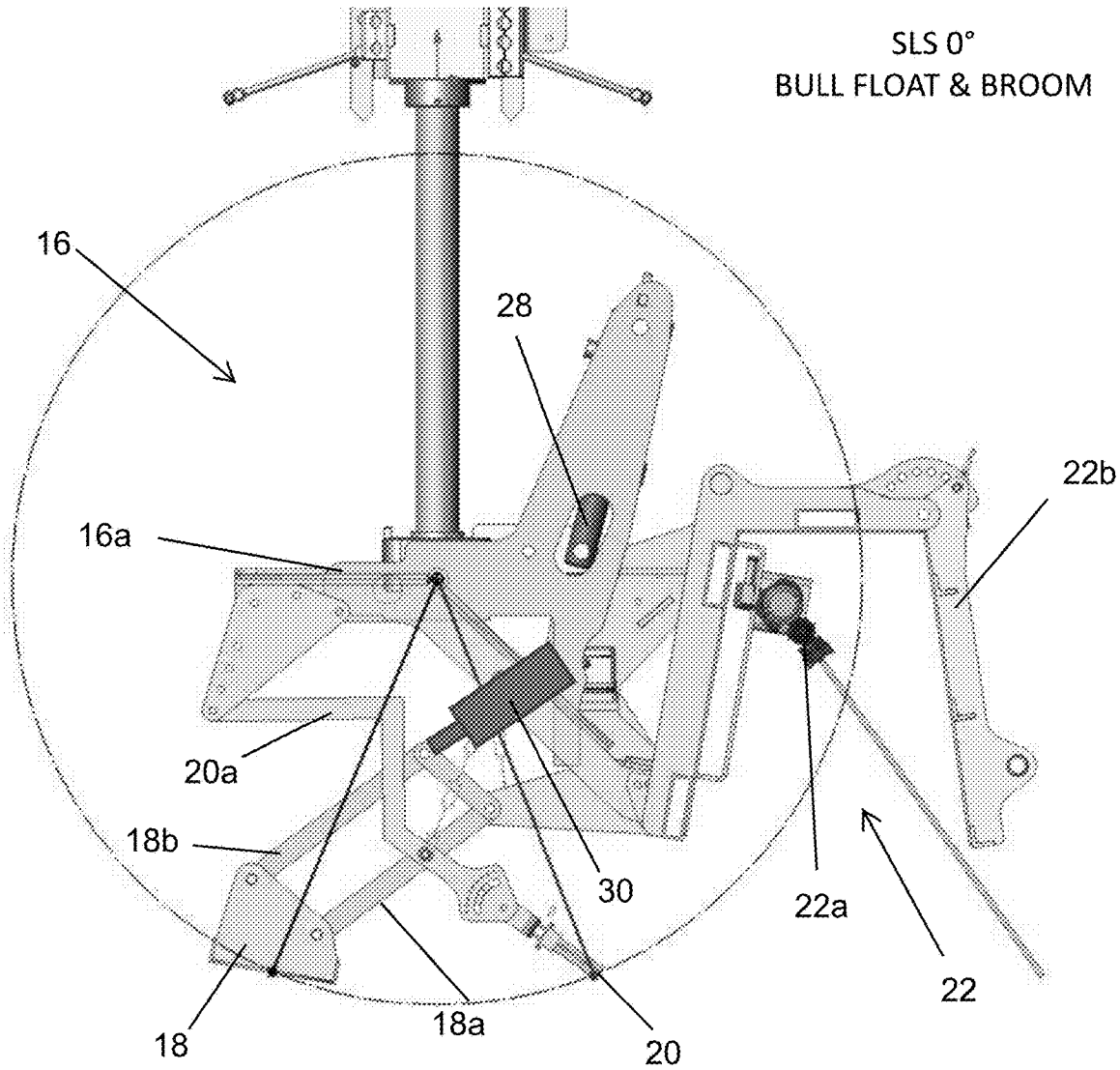
FIG. 3 is another side elevation of the finishing head of FIG. 2.
Figure 4:
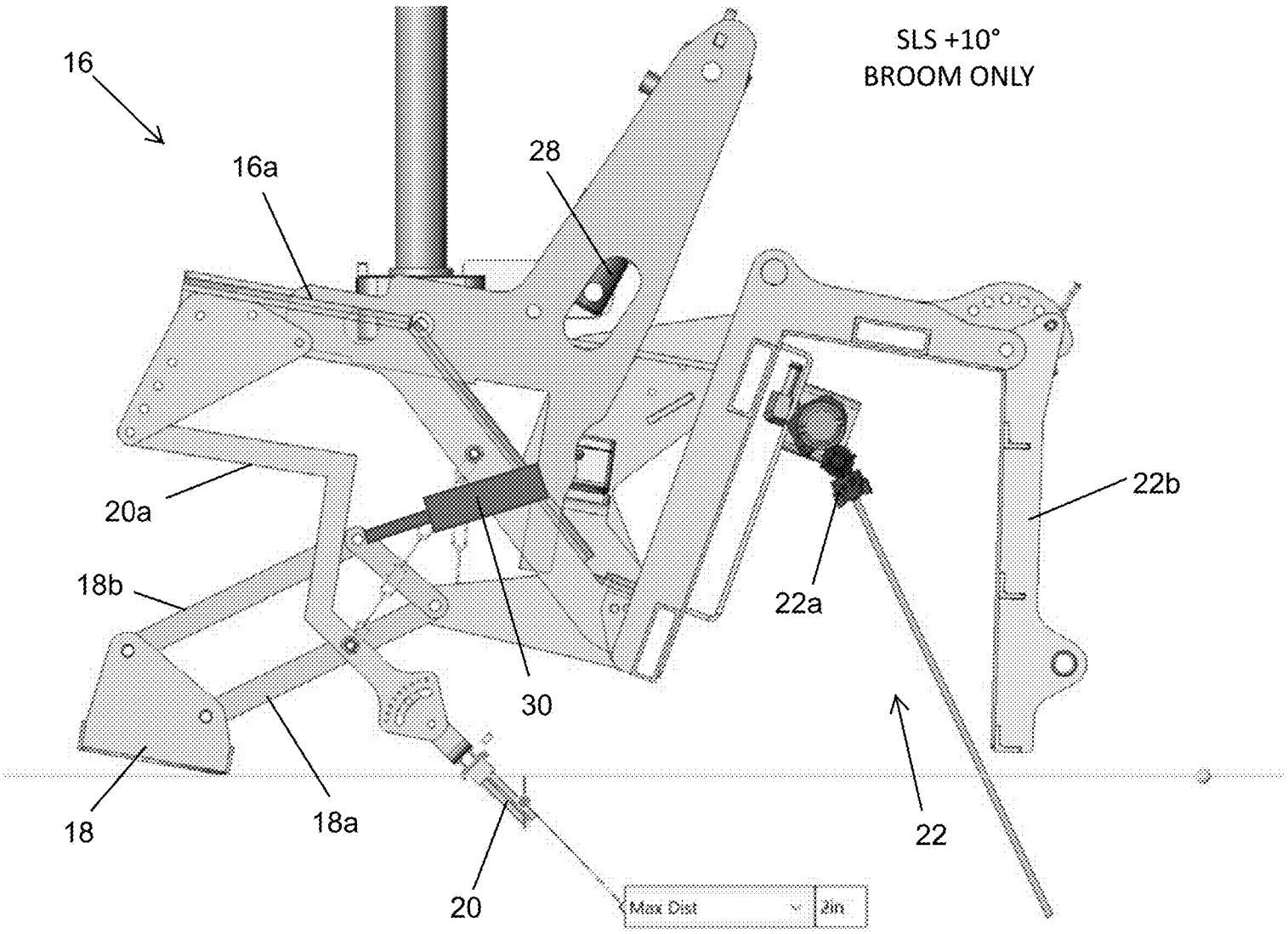
FIG. 4 is another side elevation of the finishing head of FIG. 2.

As shown in FIGS. 2-4, the finishing head 16 includes the float 18, the broom or brush element 20 and the spraying device 22. The head is vertically adjustable responsive to a laser leveling system and/or a distance/height sensing system so that the head can be moved at the appropriate level (via extension and retraction of the boom) over the concrete surface. A frame 16*a* of the finishing head 16 is pivotable about a generally horizontal axis (extending along the head) via one or more SLS actuators 28 that function to pivot the head to position the bull float or the broom at the concrete surface, as can be seen with reference to FIGS. 2-4. As the bull float is moved over the previously screeded concrete surface, the bull float levels ridges (that may occur at and along the sides of the screed passes) and fill voids left by the screeding operation, and may also slightly embed the coarse aggregate to make subsequent finishing operations easier.

The float 18 is pivotally mounted at the frame 16*a* of the finishing head 16 via a plurality of linkages 18*a*, 18*b* (which may comprise parallel linkages), which are pivoted relative to the frame via one or more float actuators 30. As shown in FIGS. 2-4, linkage 18*a* pivotally mounts to the frame 16*a* and the bull float 18, and linkage 18*b* pivotally mounts to the actuator 30 and the bull float 18, such that extension and retraction of actuator 30 changes the direction of the angle of the bottom surface of the bull float relative to the concrete surface (compare FIG. 2, showing the actuator 30 fully extended, and FIG. 3, showing the actuator 30 fully retracted).

The broom element 20 is mounted at an end of an arm 20*a* that is pivotally mounted at the frame 16*a* and that is pivotally mounted to linkage 18*a*. Thus, extension and retraction of actuator 30 also pivots arm 20*a* to raise and lower the broom element 20 relative to the concrete surface.

In the illustrated embodiment, the finishing head 16 includes the spraying device 22, which includes a plurality of spraying nozzles 22*a* disposed along and within a cover element 22*b*. The spraying device is operable to spray curing or finishing chemicals onto the concrete surface. The spraying device is fixedly attached at the frame 16*a* and thus pivots upward or downward responsive to extension or retraction of the SLS actuators 28.

Thus, the float actuator 30 is operable to change the angle direction of the float, while the SLS actuator 28 can adjust the angle to fine tune the angle of attack of the bull float. As can be seen with reference to FIG. 2, when the SLS actuator 28 is adjusted to angle the head at, for example, −10 degrees, and the float actuator 30 is extended, the broom 20 is raised and the bull float 18 is lowered so as to be moved along the concrete surface, shown with an attack angle for use when the boom is extending. As shown in FIG. 3, when the SLS actuator 28 is adjusted to angle the head at, for example, zero degrees, and when the float actuator 30 is retracted, the boom may retract with both the bull float and the broom at the concrete surface (although if desired to only have the bull float at the concrete surface during boom retraction, the float actuator 30 may be partially extended or the SLS actuator 28 may be adjusted toward the head orientation of FIG. 2). As shown in FIG. 4, when the SLS actuator 28 is adjusted to angle the head at, for example, +10 degrees, and when the float actuator 30 is extended, the boom may retract with just the broom at the concrete surface.

Figure 5:
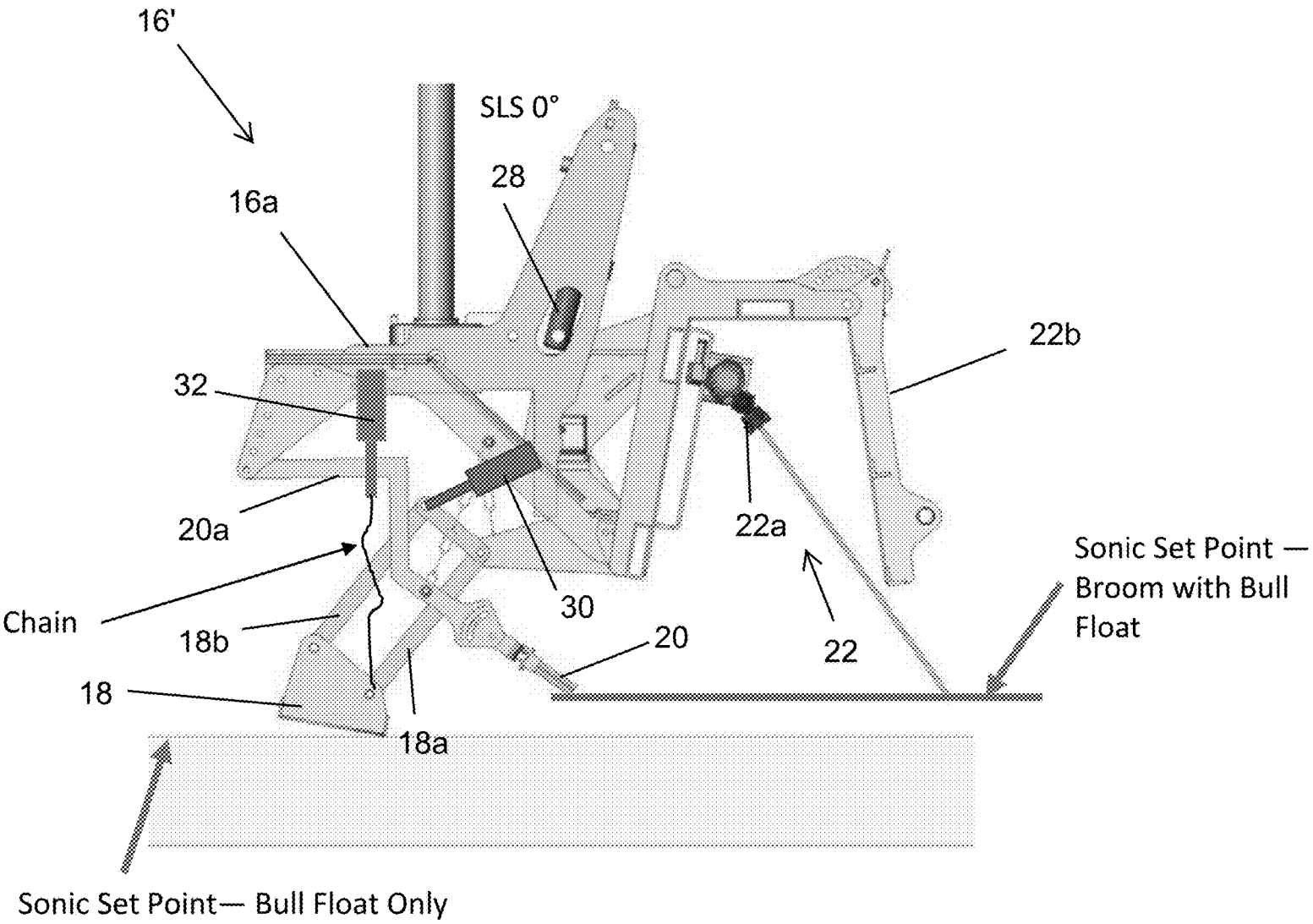
FIG. 5 is a side elevation of another finishing head with a bull float and a broom/texturing element.
Figure 6:
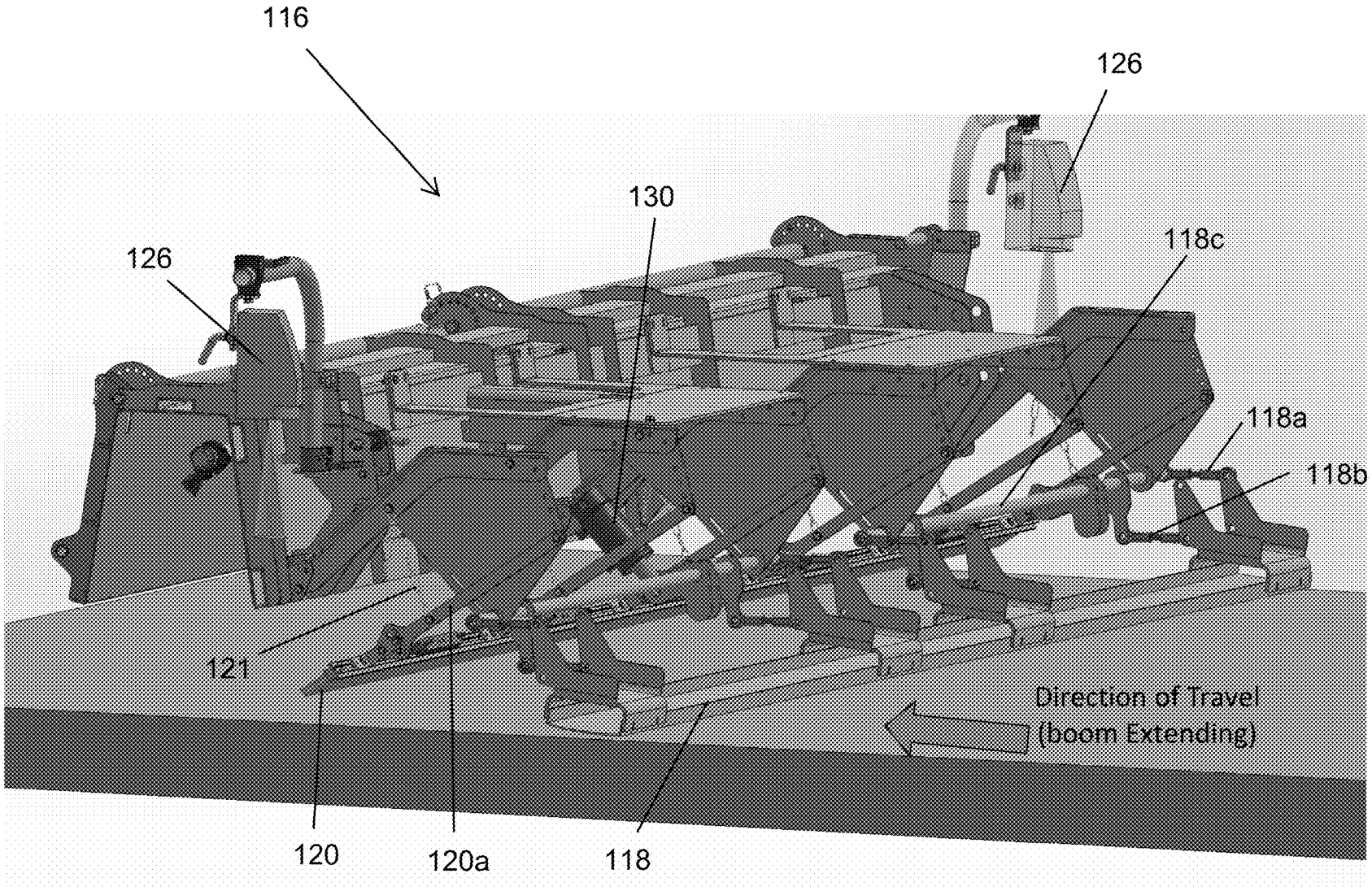
FIG. 6 is a perspective view of another finishing head with a bull float and a broom/texturing element.
Figure 7:
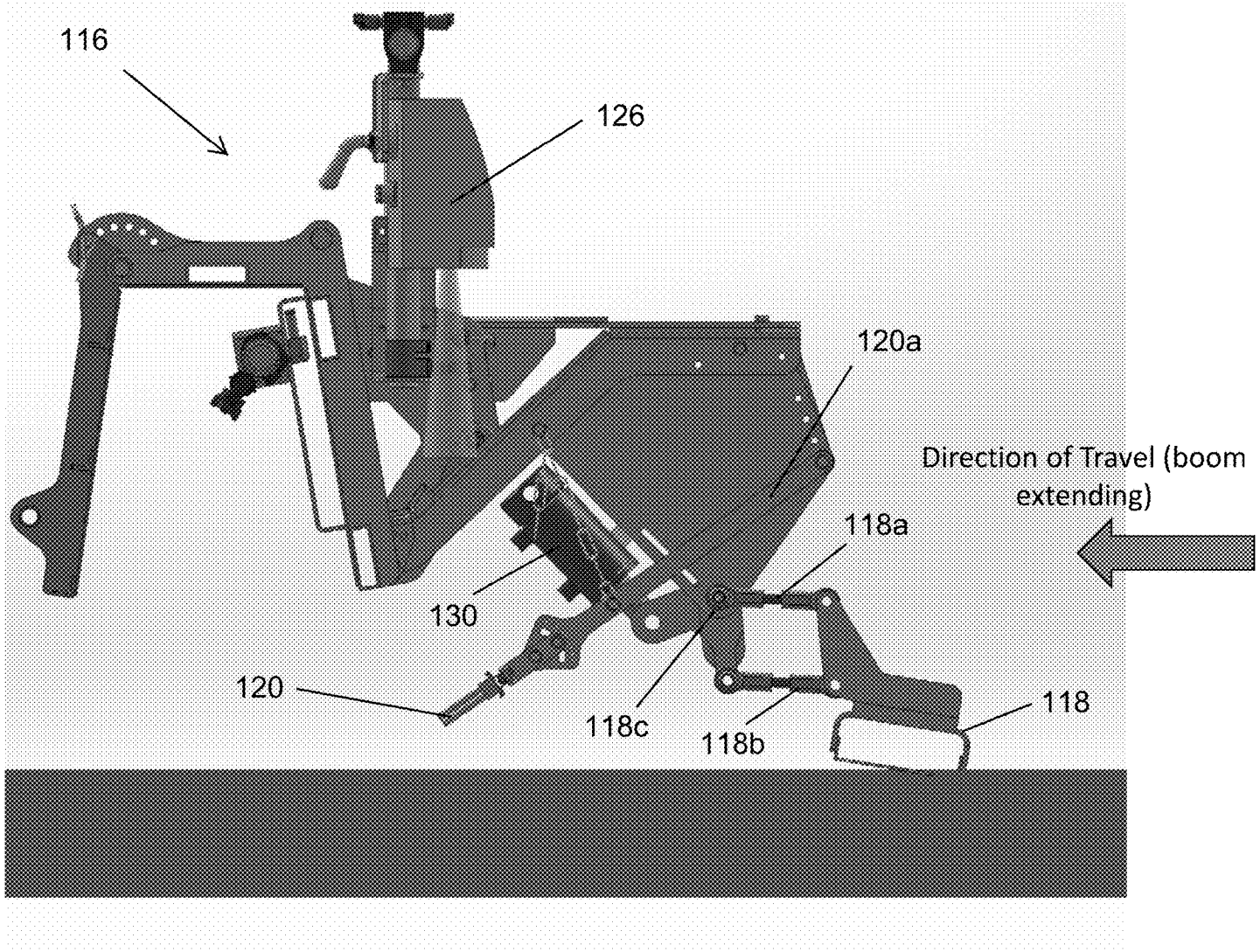
FIG. 7 is a side elevation of the finishing head of FIG. 6.
Figure 8:
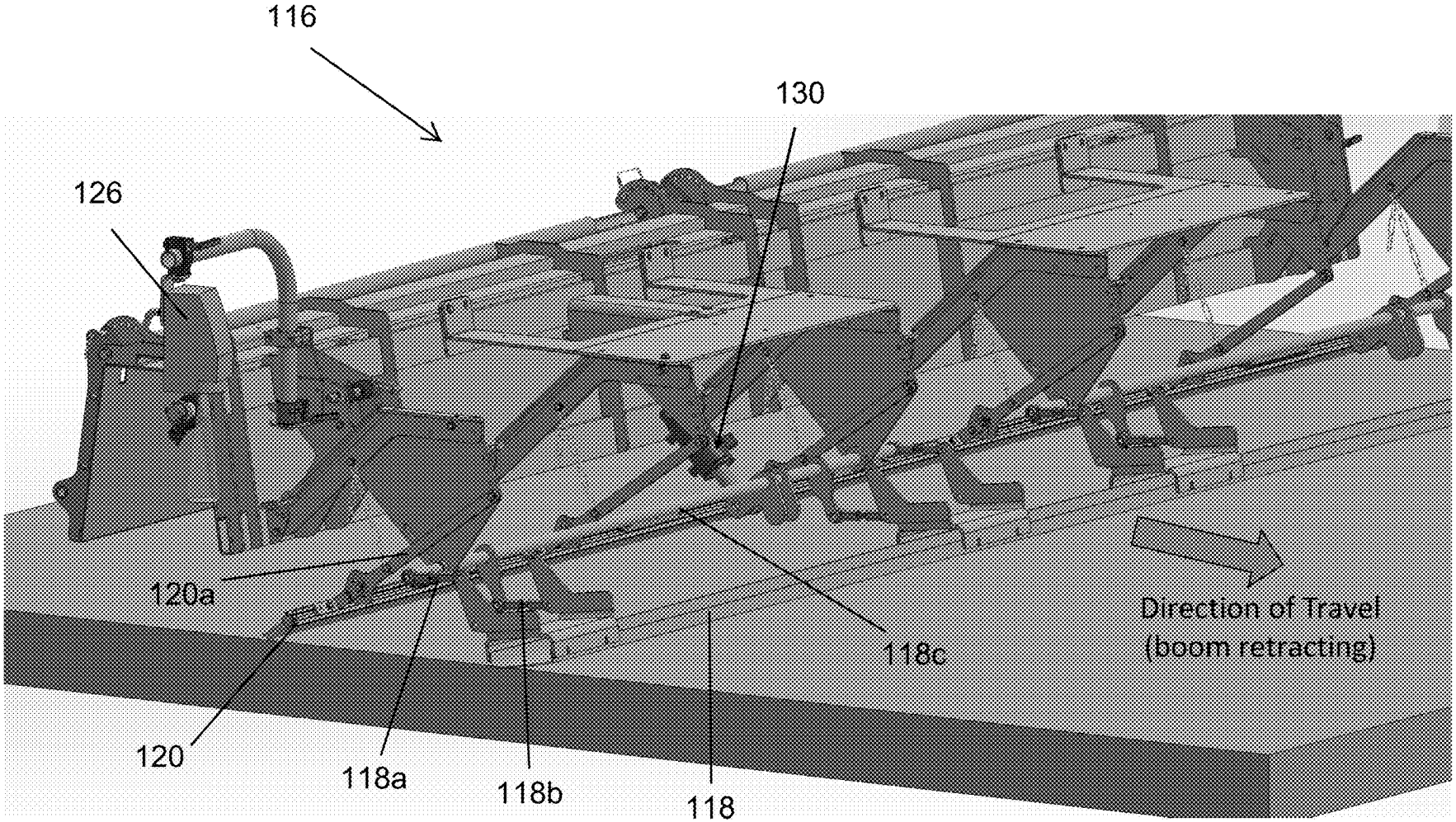
FIG. 8 is another perspective view of the finishing head of FIG. 6.
Figure 9:
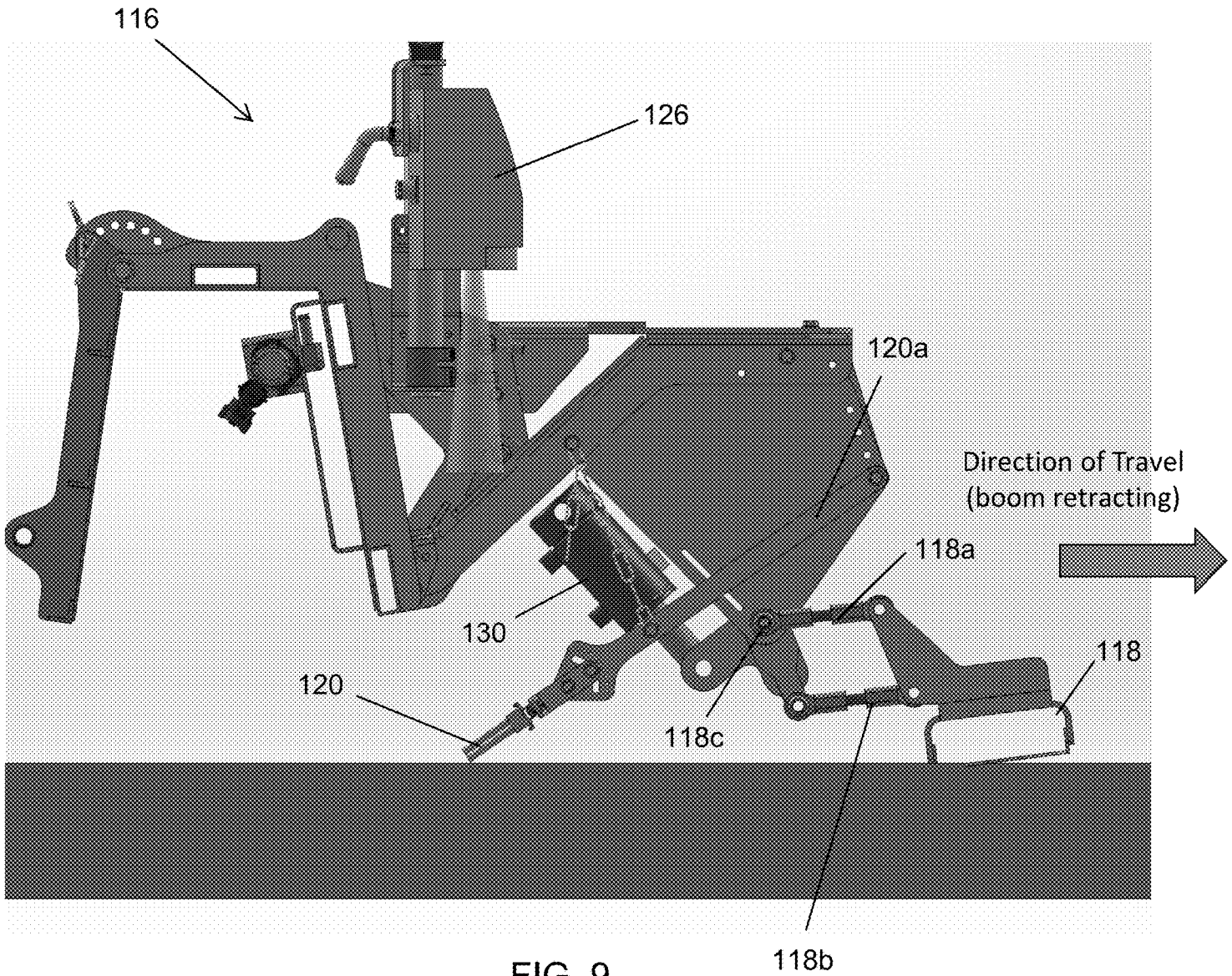
FIG. 9 is another side elevation of the finishing head of FIG. 6.
Figure 10:
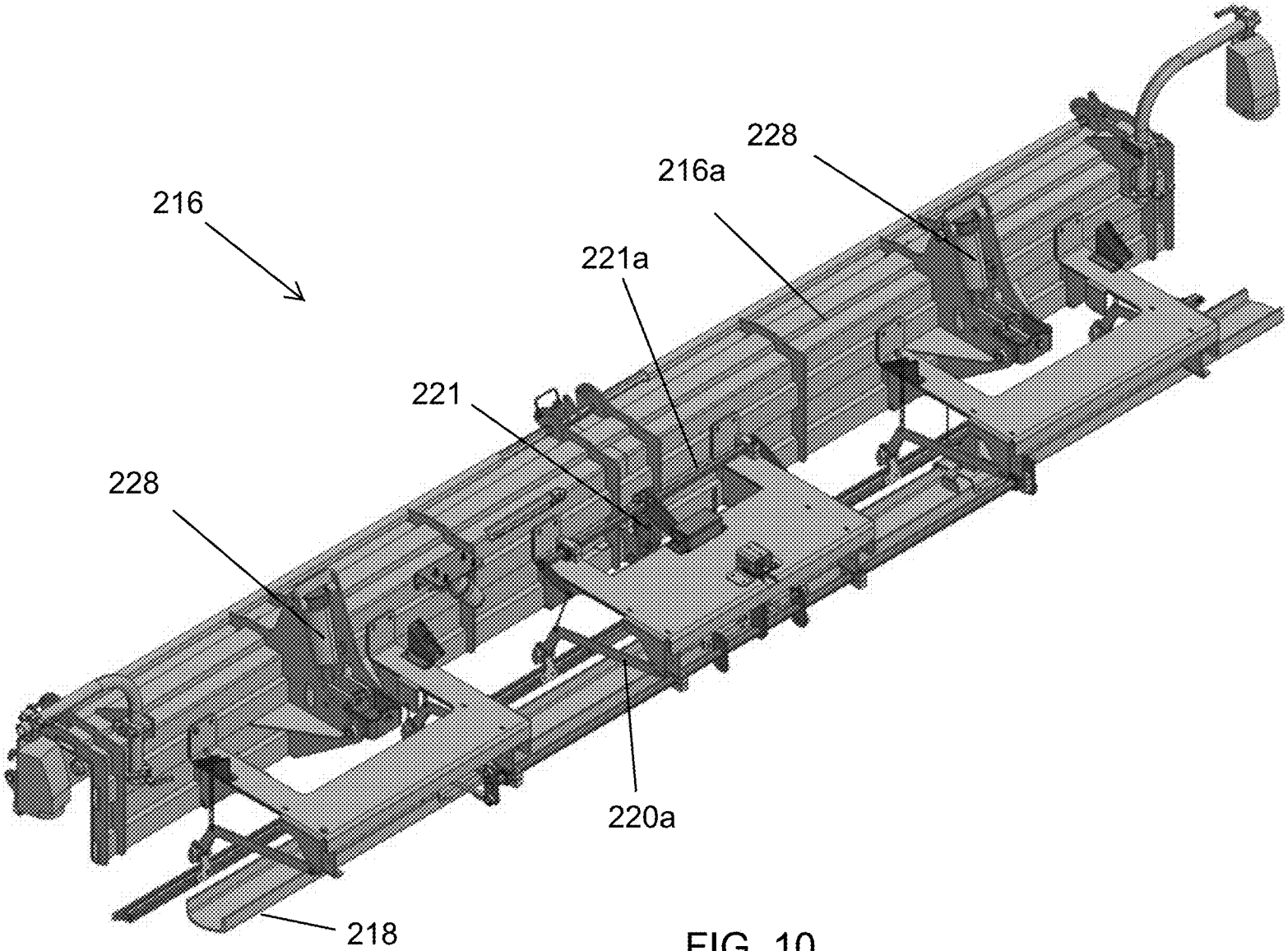
FIG. 10 is a perspective view of another finishing head with a bull float and a broom/texturing element.

Optionally, and such as shown in FIG. 5, the finishing head 16' may include an additional actuator 32 that retracts to raise the float above the concrete surface. In such an application, when it is desired to use the bull float, the actuator 32 is extended to lower the bull float, and the finishing head operates at a higher sonic set point (a greater height of the sensor above the concrete surface), and when it is desired to use the broom, the actuator 32 is retracted to raise the bull float, and the finishing head operates at a lower sonic set point (a lower height of the sensor above the concrete surface). Thus, when using the float, the sonic tracer may have a set point of, e.g., 18 inches from the surface or plane, and when using the broom, the set point may be different, such as, e.g., 16 inches from the surface or plane, so the head is lower with the broom floating on the surface. The angle of attack may be 10 degrees+/− any offset by the head actuator 28. If both the bull float and the broom are to engage the concrete surface, the finishing head may operate at the higher sonic set point, but with the actuator 32 partially extended.

As shown in FIGS. 6-9, the float 118 of a finishing head 116 is pivotally mounted (via the linkages 118*a*, 118*b*) to one or more rods 118*c* that are pivotable via respective float actuators 130. Pivotal movement of the rods 118*c* swings and pivots the bull float to adjust the direction and/or attack angle of the bull float. The broom 120 is pivotally mounted to the frame 116*a* via a plurality of arms 120*a*, with downward pivotal movement of the broom being limited by a chain 121. The finishing head includes ultrasonic sensors 126 for adjusting and maintaining the height of the head relative to the concrete surface.

As can be seen with reference to FIGS. 6-9, when the actuators 130 are retracted (FIGS. 6 and 7), the bull float is at an angle relative to the concrete surface for finishing the surface as the boom extends, and when the actuators 130 are extended (FIGS. 8 and 9), the bull float is at an angle relative to the concrete surface for finishing the surface as the boom retracts (optionally with the broom engaging the concrete surface after the bull float).

Therefore, the concrete surface finishing machine provides a float on a concrete finishing head and allows for selective use of the bull float (in either direction) and/or the broom or brush or texturing element via extension and retraction of one or more actuators. For example, the bull float actuator extends/retracts to change the bull float direction, while the head actuator adjusts or pivots the head to fine tune the angle of attack of the bull float. The bull float actuator may adjust the bull float+/−10 degrees (or more or less) for the boom extension/boom retraction pass, with fine tuning or attack angle adjustments done via extension/retraction of the head or SLS actuator.

The float may be added to a broom/texturing head. Optionally, the bull float may be pivotally mounted at a screeding head (where the float and/or plow and vibrating or screeding member may be selectively positioned at the concrete surface in a similar manner as discussed above with the float and broom). Optionally, the bull float may be adjustably positioned on a float head at the end of the boom for enhanced control of the bull float and attack angle as the boom is extended and retracted. The float is attached to the head (e.g., finishing head, screeding head or float head), such as via the 4-bar linkage or other means for holding the float at the desired angle), and has its angle of attack adjusted via extension/retraction of the float actuator (via the 4-bar linkage). Optionally, the bull float may be raised away from the concrete surface via pivoting of the head frame or via retraction of another actuator (optionally with a chain connection).

Thus, for example, the finishing machine may angle the float to float the concrete surface during extension of the boom. The machine may then switch the direction angle of the bull float and float the concrete surface during retraction of the boom. The machine may then extend the boom again and raise the float, and then retract the boom with the broom on the concrete surface to provide the desired texture at the surface, with the curing compound sprayed onto the textured or broomed surface.

Optionally, the finishing head may only utilize the bull float during retraction of the boom. For example, and such as shown in FIGS. 10-16, a finishing head 216 includes the bull float 218, the broom or brush element 220 and the spraying device 222. The head is vertically adjustable responsive to a laser leveling system and/or a distance/height sensing system so that the head can be moved at the appropriate level (via extension and retraction of the boom) over the concrete surface. The frame 216*a* of the finishing head 216 is pivotable about a generally horizontal axis (extending along the head) via one or more SLS actuators 228 that function to pivot the head relative to the boom to position the bull float or the broom at the concrete surface, such as in a similar manner as described above.

Figure 11:
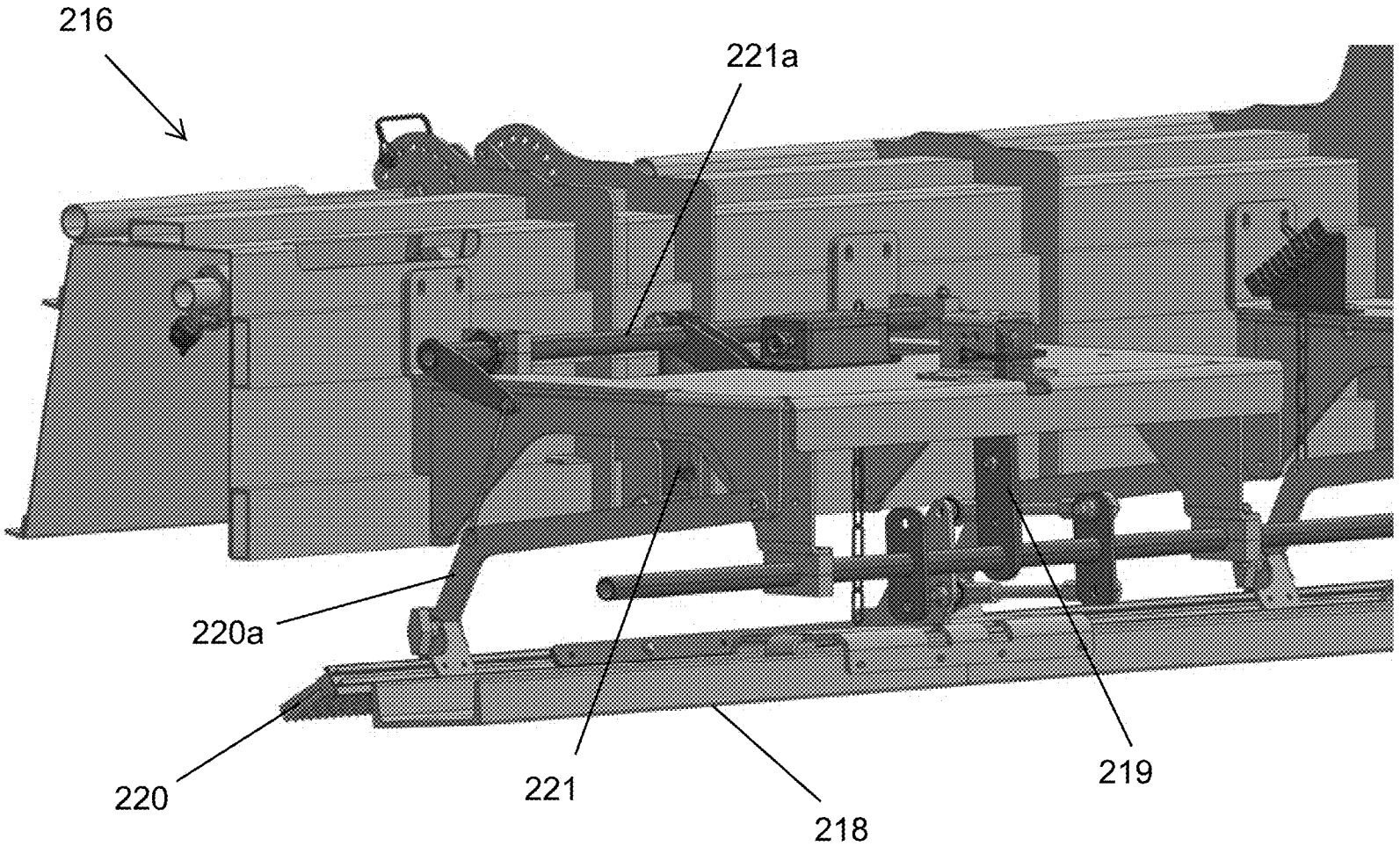
FIG. 11 is a perspective sectional view of the finishing head of FIG. 10.
Figure 12:
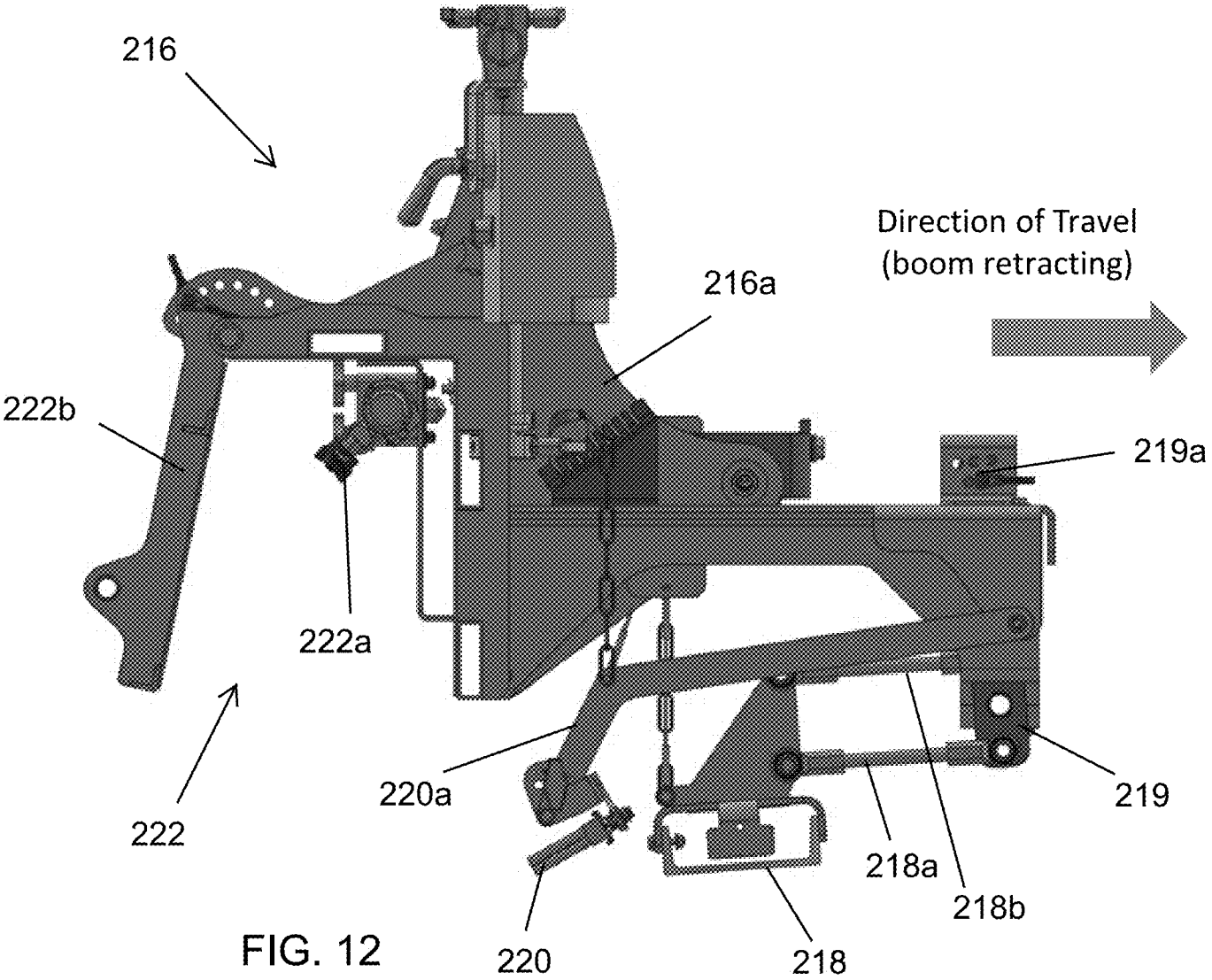
FIG. 12 is a side elevation of the finishing head of FIG. 10.
Figure 13:
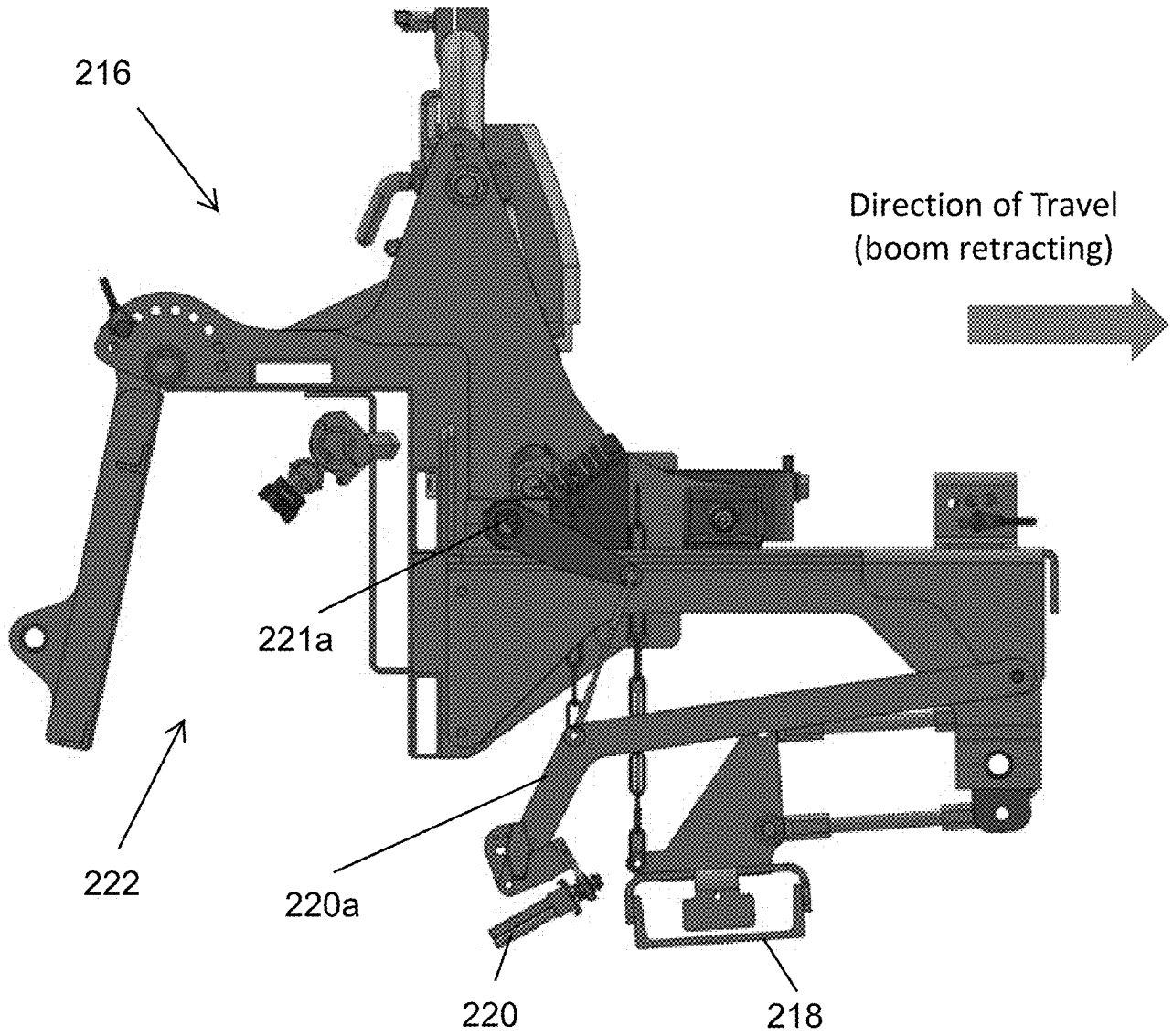
FIG. 13 is a sectional view of the finishing head of FIG. 10.
Figure 14:
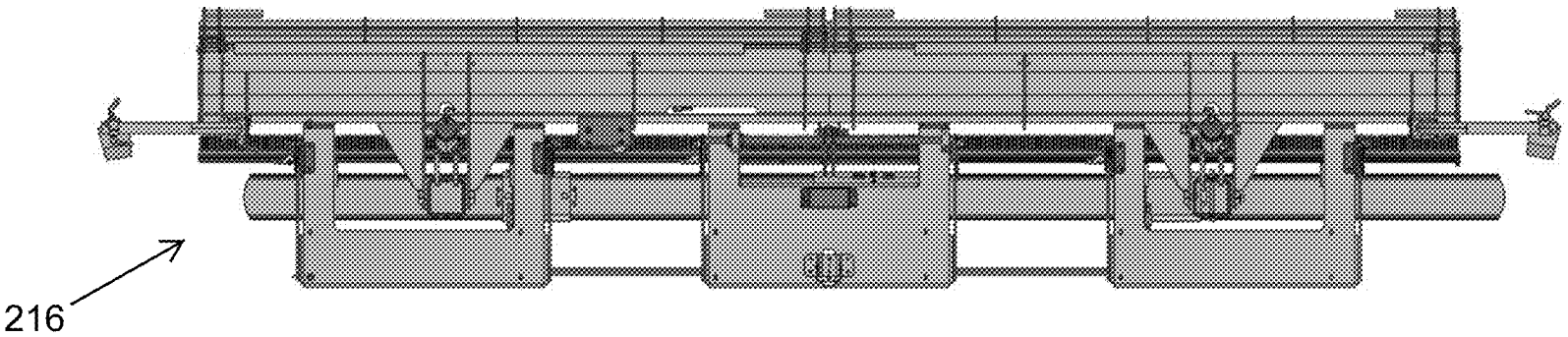
FIG. 14 is a top view of the finishing head of FIG. 10.
Figure 15:
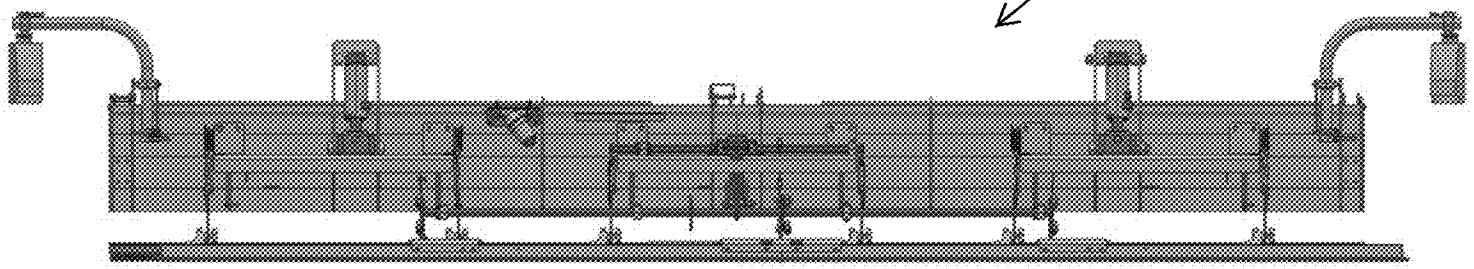
FIG. 15 is a front view of the finishing head of FIG. 10.
Figure 16:
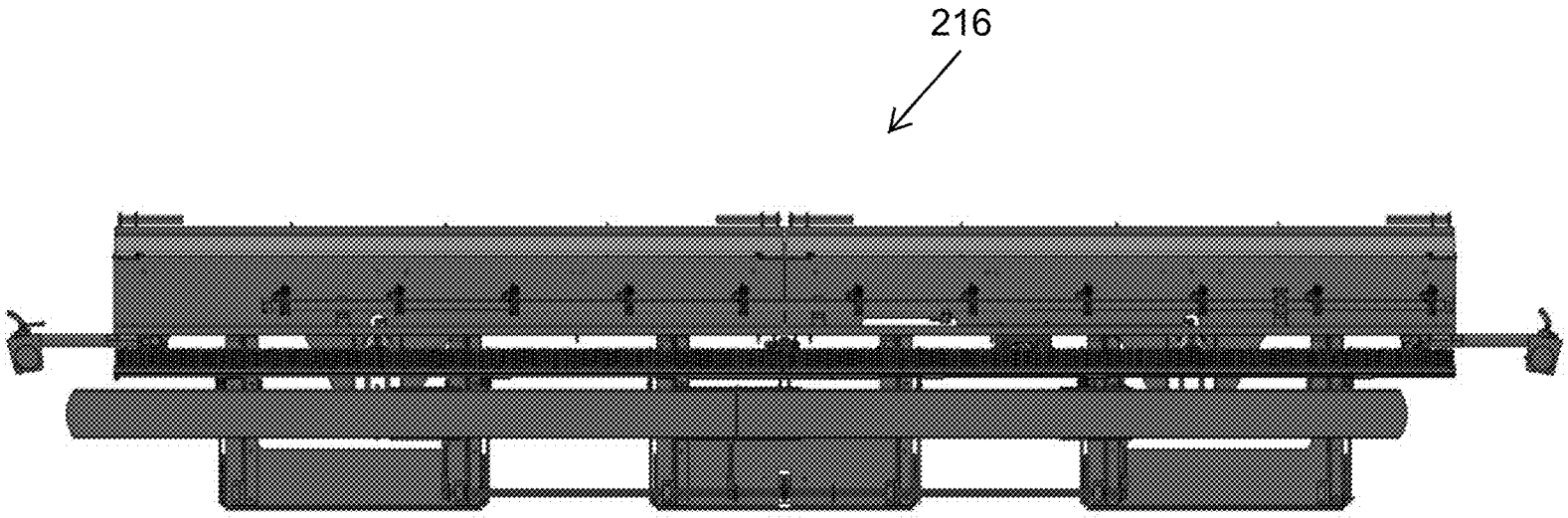
FIG. 16 is a bottom view of the finishing head of FIG. 10.

The bull float 218 is pivotally mounted at the frame 216*a* of the finishing head 216 via parallel linkages 218*a*, 218*b*. As shown in FIG. 11, the angle of the bottom surface of the bull float relative to the concrete surface can be adjusted via adjusting a pivot link 219 and retaining or securing the link at a desired location or angle relative to the frame 216*a* via a retaining pin 219*a*.

The broom element 220 is mounted at an end of an arm 220*a* that is pivotally mounted at the frame 216*a*. As also shown in FIG. 11, an actuator 221 is operable to extend and retract to pivot a linkage 221*a* to raise the arm 220*a* (such as via pivoting a linkage upward to pull upward at the arm) or to lower the arm 220*a* to raise and lower the broom element 220 relative to the concrete surface.

In the illustrated embodiment, the finishing head 216 includes the spraying device 222, which includes a plurality of spraying nozzles 222*a* disposed along and within a cover element 222*b*. The spraying device is operable to spray curing or finishing chemicals onto the concrete surface. The spraying device is fixedly attached at the frame 216*a* and thus pivots upward or downward responsive to extension or retraction of the SLS actuators 228.

Thus, the attack angle of the bull float may be set and, during operation of the finishing head, the boom is extended to position the finishing head at a starting position, and the finishing head is lowered so that the bull float (and broom) rests on the concrete surface. As the boom is retracted, the bull float and brush are dragged along the surface of the concrete ahead of the spraying nozzles. The finishing head may include similar components and may operate in a similar manner as the finishing heads 16, 116, discussed above, such that a detailed discussion of the finishing heads need not be repeated herein.

Changes and modifications to the specifically described embodiments can be carried out without departing from the principles of the present invention, which is intended to be limited only by the scope of the appended claims as interpreted according to the principles of patent law.

The invention claimed is:

1. A concrete finishing machine for finishing a concrete surface, the concrete finishing machine comprising:

a base portion and an extendable and retractable boom mounted at the base portion;

a finishing head mounted at an end of the boom distal from the base portion;

wherein the finishing head comprises a float pivotally attached at a frame of the finishing head via a plurality of linkages, and wherein the float comprises an engaging surface configured to engage the concrete surface;

wherein the finishing head comprises a float actuator that, when actuated, imparts pivotal movement of the plurality of linkages to adjust an angle of the engaging surface of the float relative to the frame and relative to the concrete surface;

wherein the finishing head comprises a surface finishing element;

wherein the concrete finishing machine is operable to selectively position the float or the surface finishing element at the concrete surface during extension or retraction of the boom;

wherein, during a float pass, the concrete finishing machine positions the float at the concrete surface and moves the finishing head via extension or retraction of the boom to move the engaging surface of the float along the concrete surface, and wherein, during the float pass, the surface finishing element is raised above the concrete surface and does not contact the concrete surface;

wherein, during a finishing pass, the concrete finishing machine positions the surface finishing element at the concrete surface and moves the finishing head via extension or retraction of the boom to move the surface finishing element along the concrete surface, and wherein, during the finishing pass, the float is raised above the concrete surface and does not contact the concrete surface; and wherein the concrete finishing machine comprises a sensing device, and wherein, responsive to the sensing device, the finishing head is maintained at a desired level or position above the concrete surface (i) with the float at the concrete surface during the float pass or (ii) with the surface finishing element at the concrete surface during the finishing pass.

2. The concrete finishing machine of claim 1, wherein selective positioning of the float or the surface finishing element at the concrete surface comprises pivoting of the frame of the finishing head via a self-level system (SLS) actuator at the finishing head.

3. The concrete finishing machine of claim 1, wherein selective positioning of the float or the surface finishing element at the concrete surface comprises lowering the float to a lowered level below the surface finishing element to position the float at the concrete surface and raising the float to a raised level above the surface finishing element to position the surface finishing element at the concrete surface.

4. The concrete finishing machine of claim 1, wherein actuation of the float actuator adjusts a direction of the angle of the engaging surface of the float at the concrete surface.

5. The concrete finishing machine of claim 1, wherein the finishing head includes a curing spray device that is operable to spray onto the concrete surface as the boom is extended or retracted.

6. The concrete finishing machine of claim 1, wherein the float is disposed at the frame of the finishing head so as to be leading the surface finishing element during retraction of the boom and trailing the surface finishing element during extension of the boom.

7. The concrete finishing machine of claim 1, wherein the boom comprises a telescoping boom.

8. The concrete finishing machine of claim 1, wherein the boom comprises an articulating boom.

9. The concrete finishing machine of claim 1, wherein the plurality of linkages comprise multiple sets of two parallel linkages.

10. The concrete finishing machine of claim 1, wherein the float comprises a bull float.

11. The concrete finishing machine of claim 1, wherein the surface finishing element comprises a texturing element that, when moved along the concrete surface during the finishing pass, textures the concrete surface.

12. The concrete finishing machine of claim 11, wherein the texturing element comprises a broom or brush element.

13. The concrete finishing machine of claim 1, wherein the sensing device comprises a distance sensor that senses a distance between the sensing device and the concrete surface.

14. The concrete finishing machine of claim 13, wherein the concrete finishing machine adjusts the height of the finishing head to a first distance when the float is at the concrete surface and to a second distance when the surface finishing element is at the concrete surface.

15. The concrete finishing machine of claim 14, wherein the first distance is greater than the second distance, and wherein the float is raised when the surface finishing element is at the concrete surface.

16. A concrete finishing machine for finishing a concrete surface, the concrete finishing machine comprising:

a base portion and an extendable and retractable boom mounted at the base portion;

a finishing head mounted at an end of the boom distal from the base portion;

wherein the finishing head comprises a frame and a float pivotally attached at the frame via a plurality of sets of linkages spaced apart along the finishing head, and wherein the float comprises an engaging surface configured to engage the concrete surface;

wherein the finishing head comprises a float actuator that, when actuated, adjusts an angle of the engaging surface of the float relative to the frame and relative to the concrete surface, and wherein the angle of the engaging surface of the float adjusts relative to the frame via pivotal movement of the sets of linkages relative to the frame and relative to the float;

wherein the finishing head comprises a surface finishing element attached at the frame;

wherein the concrete finishing machine is operable to selectively position the float or the surface finishing element at the concrete surface during extension or retraction of the boom;

wherein selective positioning of the float or the surface finishing element at the concrete surface comprises lowering the float to a lowered level below the surface finishing element to position the float at the concrete surface and raising the float to a raised level above the surface finishing element to position the surface finishing element at the concrete surface;

wherein, during a float pass, the concrete finishing machine positions the float at the concrete surface and moves the finishing head via extension or retraction of the boom to move the engaging surface of the float along the concrete surface, and wherein, during the float pass, the surface finishing element is raised above the concrete surface and does not contact the concrete surface;

wherein, during a finishing pass, the concrete finishing machine positions the surface finishing element at the concrete surface and moves the finishing head via extension or retraction of the boom to move the surface finishing element along the concrete surface, and wherein, during the finishing pass, the float is raised above the concrete surface and does not contact the concrete surface; and wherein the concrete finishing machine comprises a sensing device, and wherein, responsive to the sensing device, the finishing head is maintained at a desired level or position above the concrete surface (i) with the float at the concrete surface during the float pass or (ii) with the surface finishing element at the concrete surface during the finishing pass.

17. The concrete finishing machine of claim 16, wherein selective positioning of the float or the surface finishing element at the concrete surface comprises pivoting of the frame of the finishing head via a self-level system (SLS) actuator at the finishing head.

18. The concrete finishing machine of claim 16, wherein actuation of the float actuator adjusts a direction of the angle of the engaging surface of the float at the concrete surface.

19. The concrete finishing machine of claim 16, wherein the float is disposed at the frame of the finishing head so as to be leading the surface finishing element during retraction of the boom and trailing the surface finishing element during extension of the boom.

20. The concrete finishing machine of claim 16, wherein the boom comprises a telescoping boom.

21. The concrete finishing machine of claim 16, wherein the boom comprises an articulating boom.

22. The concrete finishing machine of claim 16, wherein each of the sets of linkages comprises a set of two parallel linkages.

23. The concrete finishing machine of claim 16, wherein the float comprises a bull float.

24. The concrete finishing machine of claim 16, wherein the surface finishing element comprises a texturing element that, when moved along the concrete surface during the finishing pass, textures the concrete surface.

25. The concrete finishing machine of claim 24, wherein the finishing head includes a curing spray device that is operable to spray onto the concrete surface as the boom is extended or retracted.

26. The concrete finishing machine of claim 16, wherein the sensing device comprises a distance sensor that senses a distance between the sensing device and the concrete surface.

27. The concrete finishing machine of claim 26, wherein the concrete finishing machine adjusts the height of the finishing head to a first distance when the float is at the concrete surface and to a second distance when the surface finishing element is at the concrete surface, and wherein the first distance is greater than the second distance.

* * * * *